US006430819B1

(12) United States Patent
Aldstadt et al.

(10) Patent No.: US 6,430,819 B1
(45) Date of Patent: Aug. 13, 2002

(54) SPORT MEASURING APPARATUS

(76) Inventors: Jeffrey E. Aldstadt, 3353 W. Brady Ave., Anaheim, CA (US) 92804; Frederick J. Grewen, 25 Crestwind Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/351,573

(22) Filed: Jul. 2, 1999

Related U.S. Application Data

(63) Continuation of application No. 09/047,897, filed on Mar. 25, 1998, now abandoned.

(51) Int. Cl.[7] ..... A63C 19/06; G01B 3/10

(52) U.S. Cl. ..... 33/1 G; 33/760; 33/27.02; 473/490

(58) Field of Search ..... 33/759, 1 G, 1 H, 33/289, 413, 414, 755, 756, 760, 679.1, 494, 562, 27.01, 27.02, 27.03, 27.031, 27.032; 473/415, 490, FOR 100, FOR 132, FOR 212; 273/317, 108

(56) References Cited

U.S. PATENT DOCUMENTS 1,045,300 A * 11/1912 Lary ..... 33/27.03
2,797,489 A * 7/1957 Roe ..... 33/760
3,039,197 A * 6/1962 Abbott ..... 33/755
3,668,781 A * 6/1972 Teter ..... 33/755
4,022,651 A * 5/1977 Larkins et al. ..... 33/27.02
4,160,324 A * 7/1979 Dunn ..... 33/759
4,880,232 A * 11/1989 Lang ..... 33/759
4,937,949 A * 7/1990 Kiefer ..... 33/1 G
5,371,949 A * 12/1994 Delaurier ..... 33/1 G
5,427,383 A * 6/1995 Viens ..... 33/759
5,800,297 A * 9/1998 Aldstadt ..... 473/490
5,928,095 A * 7/1999 Aldstadt ..... 473/490
5,935,025 A * 8/1999 Aldstadt ..... 473/490

OTHER PUBLICATIONS

Improvements Catalog (Author Unknown) Spring 1997, p. 7, Hanover, PA.

* cited by examiner

*Primary Examiner*—Christopher W. Fulton
(74) *Attorney, Agent, or Firm*—Jeffery E. Aldstadt; Frederick J. Grewen

(57) ABSTRACT

A measuring apparatus for identifying the boundaries and indicia of a basketball court or street hockey rink, respectively. In a first embodiment, the measuring apparatus comprises the combination of an elongate measuring strip and the casing for containing the same. The casing is preferably attached to the base of a portable basketball backboard and hoop set such that the measuring strip may be extended therefrom and extended across the playing surface to identify the boundaries and indicia inherent to a conventional basketball court. The second embodiment likewise comprises the combination of an elongate measuring strip and the casing for housing the same, and is designed and configured to identify the boundaries and indicia of a street hockey rink. The casing is preferably formed upon the frame of a conventional street hockey goal net with the measuring strip being extensible therefrom to measure out and identify the placement of the boundaries and indicia inherent to a street hockey rink.

12 Claims, 2 Drawing Sheets

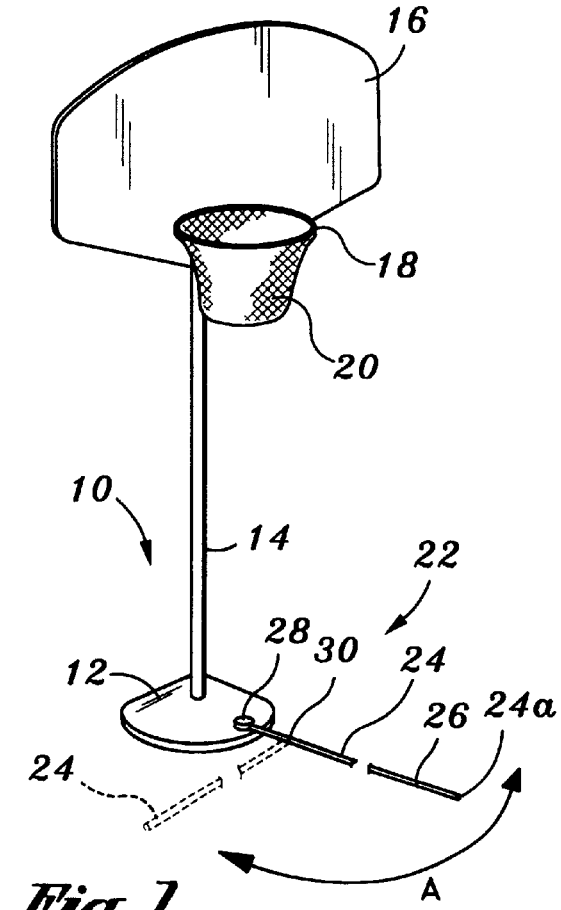
Fig. 1
Fig. 2
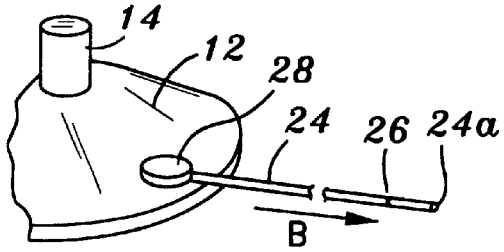
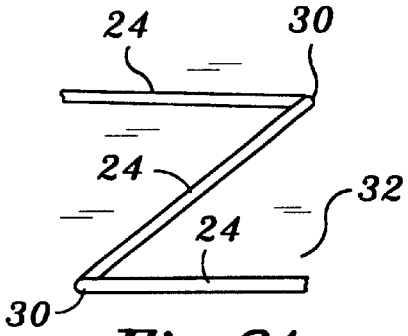
Fig. 2A
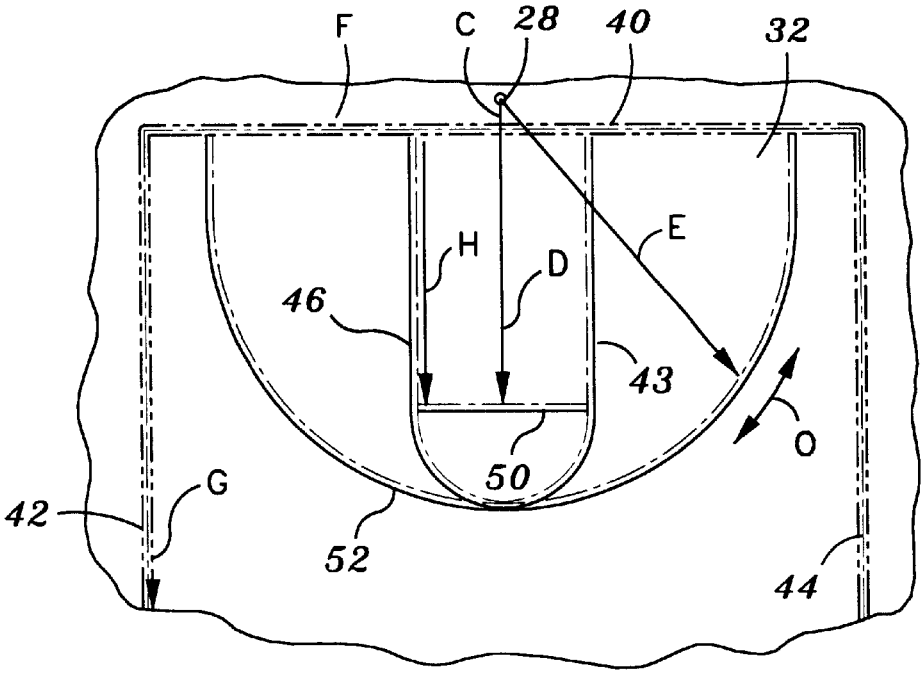
Fig. 3

SPORT MEASURING APPARATUS

CROSS-REFERENCE TO RELATED APPLICATIONS

The present application is a continuation patent application of U.S. patent application Ser. No. 09/047,897, now abandoned, entitled SPORT MEASURING APPARATUS filed on Mar. 25, 1998, now abandoned.

FIELD OF THE INVENTION

The present invention relates generally to sporting goods equipment, and more particularly, to measuring apparatuses for forming either a basketball court or street hockey rink upon a playing surface.

BACKGROUND OF THE INVENTION

For the past several years, the sports of basketball and street hockey have grown tremendously in popularity and provide excellent means for developing physical endurance and athletic skill. Partially responsible for this rise in popularity is the widespread availability of portable basketball backboard and hoop sets and hockey goal nets, which enable such sports be played virtually on any street, parking lot or other generally flat playing surface.

In order to play such sports in this context, however, it is necessary that the boundaries and other indicia of the courts and rinks upon which the same are played be clearly identified. Otherwise, the players playing such sport will have no clear demarcation as to what is and what is not "out of bounds". Indeed, disputes among players can and do frequently arise over whether a player, ball or puck is "in" or "out", which can thus cause great hostility and unsportsmanlike behavior. As a consequence, the fun and excitement of the game is ruined.

This need for clearly identified court boundaries is especially necessary in basketball where not only is there a need to identify the peripheral boundaries of the court, which can affect which team is given possession of the ball, but also to identify other key locations on the court, such as the freethrow line and three-point line, which can affect the scoring of the game. Additionally, such clearly identified boundaries and areas are necessary to enable players to properly practice shooting freethrows and three-point shots as the distance from where the shot is made to the basketball hoop is the controlling factor for each such respective shot. Indeed, this need is especially compelling in light of the proliferation of portable backboard sets sold during the past few years that lack the boundaries to properly use them.

The sport of street hockey likewise necessitates that the borders and other indicia of the rink within which the sport is played be clearly defined. In this regard, the sport of street hockey, as with conventional ice hockey, incorporates the use of face-off circles selectively positioned within the rink, as well as indicia defining an attacking zone, neutral zone, and defending zone. Such sport further requires the accurate placement of the goals into which players of opposing teams "shoot" the puck.

To properly mark the boundaries of a given court or rink, however, is time consuming and requires considerable effort. In this regard, the respective boundaries of either court or rink must first be accurately measured and thereafter clearly indicated on the playing surface. The latter task is especially problematic as each boundary or other indicia must be accurately made on the playing surface, as with chalk or paint for example. Moreover, due to the fact that the sports of basketball and street hockey are typically played with portable equipment (i.e., portable basketball backboard sets and street hockey goal nets), the task of having to mark such boundaries must often be repeated as such portable equipment is moved from location to location. In these instances, the boundaries of a given court or rink must be determined and continuously redetermined based upon where such portable backboard/goal net is positioned.

Accordingly, there is a need for a measuring apparatus that can quickly, easily and accurately provide an indication as to where the various boundaries and other indicia of a basketball, court or street hockey rink are properly located in relation to a given basketball backboard or hockey goal net used therewith. There is further a need for such a measuring apparatus that is of simple construction, and may be easily and readily utilized with virtually all types of portable basketball backboard sets and/or street hockey goal net apparatuses.

SUMMARY OF THE INVENTION

The present invention specifically addresses and alleviates the aforementioned deficiencies in the art. Specifically, the present invention comprises a measuring apparatus attachable to or formed as an integral part of either a portable basketball backboard and hoop set or a street hockey goal net for forming, respectively, a standardized basketball court or street hockey rink upon a planar playing surface. In a preferred embodiment, the measuring apparatus comprises an elongate measuring strip having a plurality of indicators spaced therealong to indicate the appropriate placement and position of the respective boundaries and indicia a given court or rink. The elongate measuring strip is contained within a casing or housing, preferably in a spool-like configuration as per conventional measuring tape devices, such that a respective opposed end remains anchored within the casing while the respective other opposed end may be manually withdrawn therefrom, via an opening formed on the casing, and pulled over the playing surface to thus indicate the proper placement of the various boundaries/indicia of the court or rink. To enable the elongate measuring strip to measure out and indicate the appropriate placement of court boundaries/indicia at angles relative to or behind the basketball backboard/hoop and/or street hockey goal net, the casing holding the elongate measuring strip may have one or more joints formed thereon to enable the strip to assume angled configurations, and in particular, right angles. Additionally, the elongate measuring strip may be pivotally mounted upon the basketball backboard/hoop and/or street hockey goal net to further enable the device to properly indicate the placement of various court or rink boundaries and/or indicia.

It is therefore an object of the present invention to provide a measuring apparatus that can quickly, easily and accurately indicate the correct position and placement of the respective boundaries of either a basketball court or street hockey rink upon a planar playing surface.

Another object of the present invention is to provide a measuring apparatus for indicating the correct position of the respective boundaries of either a basketball court or a street hockey rink upon a planar playing surface that can accurately provide such indication relative to a respective portable basketball backboard/hoop set or street hockey goal net.

Another object of the present invention is to provide a measuring apparatus for indicating the correct position and placement of the respective boundaries and indicia of either a basketball court or a street hockey rink that is of simple construction, inexpensive to manufacture, and may be used in combination with conventional sporting goods equipment.

BRIEF DESCRIPTION OF THE DRAWINGS

These, as well as other features of the present invention, will become more apparent upon reference to the drawings, wherein:

FIG. 1 is a perspective view of a conventional portable basketball backboard and hoop assembly having a measuring apparatus constructed in accordance to a first preferred embodiment of the present invention formed upon the base thereof for indicating the placement and position of the boundaries of a basketball court about the basketball backboard/hoop set;

FIG. 2 is a perspective view of a portion of the base of the portable basketball backboard/hoop set further illustrating the measuring apparatus of the present invention;

FIG. 2*a* is a perspective view of an elongate measuring strip comprising part of the measuring apparatus of the present invention assuming an angled, zig-zag configuration;

FIG. 3 is a top view of the dimensions of a conventional basketball court as formed by the measuring apparatus depicted in FIG. 2;

DETAILED DESCRIPTION OF THE PREFERRED EMBODIMENT

Figure 2B:
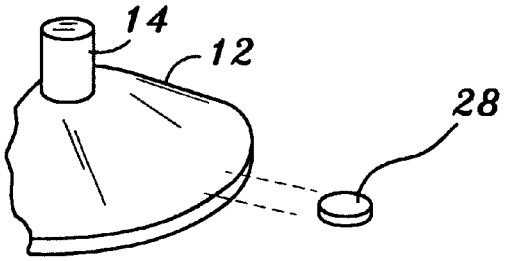
FIG. 2*b* is a perspective view of the measuring apparatus of the present invention shown detached from the base of the portable basketball backboard/hoop of FIG. 2.

The detailed description set forth below in connection with the appended drawings is intended merely as a description of the presently preferred embodiments of the invention, and is not intended to represent the only forms in which the present invention may be constructed or utilized. The description sets forth the functions and sequence of steps for constructing and implementing of the invention in connection with the illustrated embodiments. It is to be understood, however, that the same or equivalent functions and sequences may be accomplished by different embodiments that are also intended to be encompassed within the spirit and scope of the invention.

Referring now to the drawings, and initially to FIG. 1, there is shown a conventional portable basketball backboard and hoop set 10 having a court measuring apparatus 22 formed thereon for measuring out and indicating the accurate position and placement of the boundaries and court indicia of a basketball court upon a planar surface, the latter being constructed in accordance to a first preferred embodiment of the present invention. As is well-known, such portable basketball backboard/hoop sets 10 are available in most major sporting good stores and are in widespread use both domestically and abroad. In this regard, most sets typically comprise a base 12 that can either be anchored or weighted down to thus enable the set 10 to become firmly planted into position. The set further includes a pole 14 that raises the backboard 16 and hoop 18 and net 20 to a standardized height, typically ten feet, above the playing surface.

Advantageously, such portable sets 10 enable the sport of basketball to be played upon virtually any planar playing surface. Additionally, because of their portable nature, such sets 10 can be easily and readily transported to any suitable place spacious enough to accommodate a game of basketball. For example, such portable basketball backboard/hoop sets 10 can enable the game of basketball to be readily played on neighborhood streets, parking lots or any of a plurality of paved/concrete surfaces, including indoor surfaces such as those commonly associated with warehouses and the like.

Notwithstanding the advantages of such sets 10, substantial problems exist when attempting to define the appropriate court boundaries and other court indicia, namely, the key and three-point zone, inherent to the sport. As is well-known to those familiar with the sport, the boundaries of the basketball court, key and three-point zone thereof, have a substantial effect on the scoring of the game, as well as which team is given possession of the ball. Currently, however, the prior art is lacking in any sort of device or system that can enable the dimensions of a basketball court, as well as other court indicia, to be quickly, easily and accurately formed about a portable basketball backboard/hoop set to thus eliminate any confusion amongst players as to where the same lie.

The court measuring apparatus 22 of the present invention is specifically designed and configured to address such needs. In the embodiment depicted, the measuring apparatus 22 comprises an elongate measuring strip 24 having proximal and distal ends, the former being anchored to the portable basketball backboard and hoop set 10, and more particularly the base 12 thereof, and a distal end 24*a* that is designed to be extended about the playing surface about the basketball backboard/hoop set 10 to indicate the placement of the various boundaries and indicia of a basketball court thereabout. To assist the user, indicators, such as 26, are formed upon the measuring strip 24, to provide a clear indication as to where a specific boundary or court marking is located. Additionally, and as discussed more fully below, there is preferably provided one or more joints 30 along the length of the measuring strip 24 to enable the same to assume angled configurations such that various segments thereof may rotate relative one another, as indicated by the letter A.

As more clearly seen in FIG. 2, the elongate measuring strip 24 is preferably housed within a casing 28, the latter preferably being formed as an integral part of the base 12 or, alternatively, detachably fastenable thereto following the word thereto. In this respect, it is contemplated that the measuring apparatus 22 may take the form of a conventional tape measure such that the elongate measuring strip 24 housed within the casing 28 with the proximal end of the strip remaining anchored within the casing 28 while the distal end 24a may be manually extended therefrom via an opening formed upon the casing 28. Additionally, similar to conventional tape measures, the elongate measuring strip 24 may be designed and configured to be spooled within the casing 28 when not in use. Moreover, such casing may be provided with a spring or biasing member disposed therein to thus bias the measuring strip to assume such spooled or coiled configuration.

As will be easily understood and appreciated by those skilled in the art, the elongate measuring strip 24 housed within the casing 28 may be quickly and easily utilized to determine the various court indicia inherent to conventional basketball courts, such as those depicted in FIG. 3. As illustrated, there is shown the baseline 44 and respective sidelines 42, 44 of one-half of a conventional basketball court. Additionally depicted is the key of such basketball court, the latter being defined by lines 46, 48 and freethrow line 50. Additionally depicted is the three-point line 52 positioned according to the layout of a regulation National Collegiate Athletic Association (NCAA) basketball court.

To accurately indicate each of the aforementioned boundaries/court indicia, there is provided upon the measuring strip a plurality of selectively positioned indicators, for example, such as 26 depicted in FIGS. 1 and 2, that indicate the proper orientation and placement thereof. In this respect, the user need only pull out the measuring strip 24 from the casing 28 anchored to the base 12 in the direction indicated by the letter B in FIG. 2 and walk straight in a direction away from the base 12 to such distances where an appropriate boundary and/or specific court indica will be positioned, as will be indicated by the various indicators formed upon the measuring strip. For example, markings formed upon the measuring strip 24, once the distal end of the latter is sufficiently pulled distance D away from casing 28, shown in FIG. 3, will indicate the proper position of the freethrow line 50, which, once determined, may be indicated by drawing a chalk line thereat. The three-point line 52 may similarly be indicated by measuring out distance E and thereafter rotating the distal end of the measuring strip 24 in circular pathway O such that the outer arcuate portion of the three-point line 52 is formed. As will be recognized, the formation of the three-point line 52 may be indicated by chalk and the like. To facilitate such rotational movement, casing 28 may preferably be pivotally mounted upon base 12 of basketball backboard and hoop set 10.

Other indicia, such as the baseline 40 and sidelines 42, 44 and lines defining the sides of the key 46, 48, may likewise be properly indicated by measuring out distances C and F, G, and H, respectively, which will conform to specified standardized dimensions. As discussed above, to enable the measuring apparatus 22 to measure such indicia, there is preferably formed upon the measuring strip 24 thereof one or more joints 30 to enable the measuring strip 24 to assume angled configurations, and more particularly, right angles, as shown in FIG. 2*a*, for example. Advantageously, by providing a measuring strip 24 capable of assuming such angled configurations, such measuring strip 24 will advantageously be able to indicate the proper positioning of those court boundaries and other indica extending away from the base 12 of the basketball backboard/hoop set, such as sidelines 42, 44 and the baseline 40 of the court.

For example, in order to measure baseline 40, the user need only pull the measuring strip length C and bend the same approximately 900 at a joint (not shown) formed thereat and extend the strip 24 the length F (and repeat such process for the respective other side of the court). To thereafter utilize the strip 24 to properly assume and indicate the placement of sideline boundary 42 the user need only continue to pull the measuring strip 24 out a further length G and bend the same at joints selectively formed upon the measuring strip 24, similar to the zig-zag configuration depicted in FIG. 2*a*, such that the sideline boundary 42 is indicated upon the playing surface 32. Similarly, by bending the measuring strip 24 at other selectively positioned joints, the measuring strip will thus be able to indicate the appropriate position and length of the sides 46, 48 of the key, as represented by length H. As will be recognized, it is contemplated that the casing 28, which is capable of rotating or pivoting about a central axis (so as to form the three-point line 52 discussed above) may also assume a locked configuration to thus enable the measuring strip 24 to assume the aforementioned desired angled configuration for purposes of measuring the baseline 40, sidelines 42, 44 and sides 46, 48 of the key.

Figure 4:
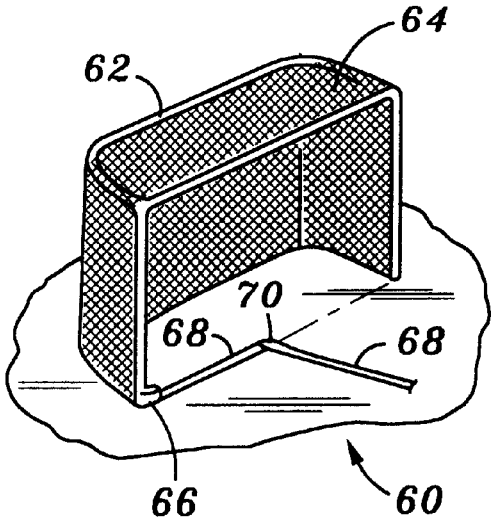
FIG. 4 is a perspective view of a conventional portable street hockey goal net having a measuring apparatus constructed in accordance to a second preferred embodiment of the present invention formed thereon for indicating the proper placement and position of the boundaries of a street hockey rink about said portable goal net.
Figure 5:
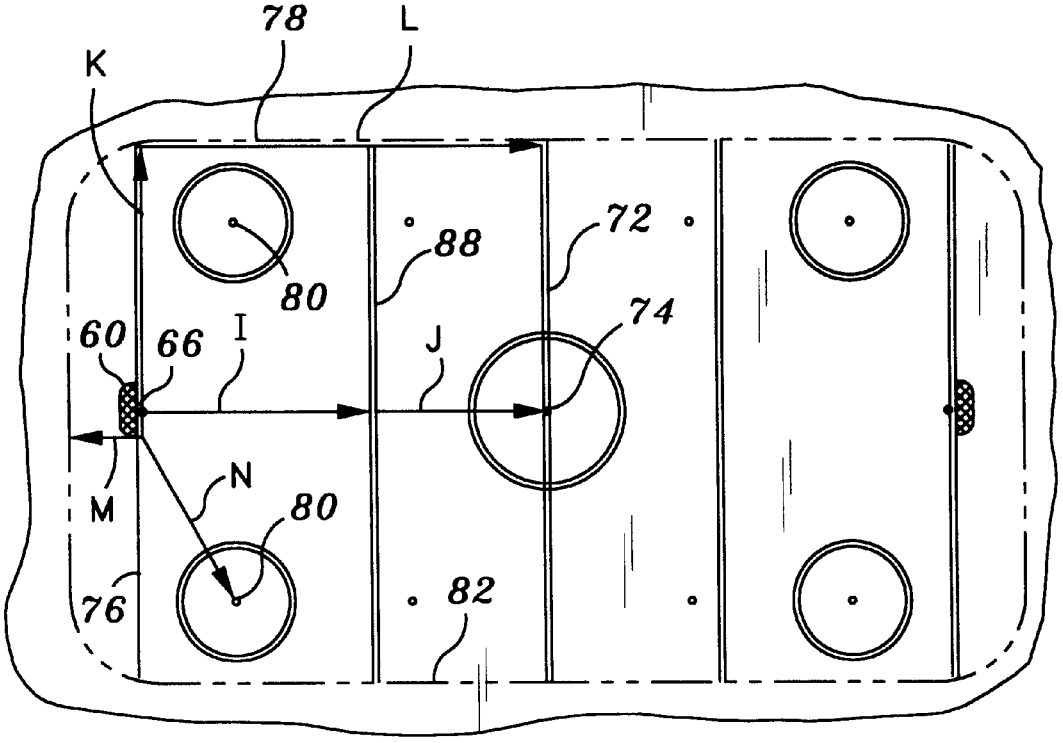
FIG. 5 is a top view of a conventional street hockey rink, the boundaries of which being formed by the measuring apparatus depicted in FIG. 4.

Referring now to FIG. 4, there is shown a second embodiment of the present invention, and more particularly, a measuring apparatus 60 for use in determining the specific boundaries of a street hockey rink. Such device, which is similar in construction to the first embodiment for forming the dimensions of a basketball court, comprises a casing 66 having a measuring strip 68 housed therein. Such measuring strip 68, however, is provide with indicia thereon to indicate the accurate placement of the various standardized boundaries and indicia inherent to a street hockey rink.

As illustrated, the measuring apparatus 60 is designed and configured to be used in combination with a conventional street hockey goal apparatus. As is well-known, such goal apparatus comprises the combination of a frame 62 defining an opening and net portion 64 attached thereto. As with the sport of ice hockey, the objective of the game is for teams to score goals against opposing teams (i.e., "shoot" a puck through the frame 62 and into the net 64).

The measuring apparatus 60, according to the second embodiment, is preferably formed upon or is attachable to the base of the frame 62, and preferably at the base of one of the two posts of the frame 62 defining the opening of the goal, as shown in FIG. 4. The measuring strip 68 may be extended from the casing 66 and pulled across the playing surface whereby indicators or markers formed upon the measuring strip 68 will indicate the position of the various boundaries and indicia inherent to the street hockey rink, including, but not limited to, the center of the face-off circle 74, the centerline 73, the blue line 70, and the centers 80 of the side face-off circles all of which according to standardized dimensions. The measuring strip 68 may further be utilized to measure out and identify goal line 76, as well as side boundaries 78 and 82, as per regulation dimensions.

Specifically, to identify the distance from the center of the goal net to blue line 70, the length I is measured, and the center 74 of the center face-off circle is identified by further extending the measuring strip 68 an additional length J. The length of one-half of goal line 76 is identified by measuring out the length K and, via a joint (not shown) formed on the measuring strip 68, length L is measured to identify the length and placement of side boundary 78. The regulation distance behind the goal is indicated by the letter M and by measuring out the length N, a respective one of the centers 80 of the side face-off circles may be appropriately identified.

To enable the measuring apparatus to properly identify the placement of such borders and indicia, the measuring strip thereof will preferably include a plurality of joints such as 70 depicted in FIG. 4, to enable the measuring strip 68 to assume angled configurations, similar to the first embodiment. As will be recognized by those skilled in the art, by enabling the measuring strip 68 of the measuring apparatus of the present invention to assume such angled configurations, such measuring strip 68 will be able to extend from the casing thereof and assume and indicate the placement of the various court indicia.

Although the invention has been described herein with specific reference to presently preferred embodiments thereof, it will be appreciated by those skilled in the art that various additions, modifications, deletions and alterations may be made to such preferred embodiment without departing from the spirit and scope of the invention. In this regard, it should be understood that the respective embodiments of the measuring apparatuses 22, 60 may be used in combination with a respective second of such devices so that a full length basketball court or street hockey rink may be formed. Likewise, while the respective embodiments herein contemplate the use of the measuring strip having a plurality of joints formed thereon, such measuring strip may take the form of a string, chain or other like device that may be readily conformed to the dimensions of a respective basketball court or street hockey rink. Accordingly, it is intended that all reasonably foreseeable additions, modifications, deletions and alterations be included within the scope of the invention as defined in the following claims.

What is claimed is:

1. A measuring apparatus for indicating the position of the boundaries and indicia of a basketball court upon a planar surface relative a portable basketball backboard and hoop set, the measuring apparatus comprising:

an elongate measuring strip having proximal and distal ends, said proximal end beings attachable to said portable basketball backboard and hoop set such that said distal end freely extends therefrom, said elongate measuring strip having indicia formed thereon for indicating the position of the baseline, freethrow line, three-point line and sidelines of a conventional basketball court when said measuring strip is extended across said planar surface; and a casing for housing said elongate measuring strip, the proximal end of said measuring strip being anchored within said casing, said casing having an aperture formed thereon to enable the distal end of said measuring strip to extend therefrom.

2. The measuring apparatus of claim 1 wherein said casing is pivotally mountable upon said portable basketball backboard and hoop set.

3. The measuring apparatus of claim 1 wherein said casing is integrally formed as part of said portable basketball backboard and hoop set.

4. The measuring apparatus of claim 1 wherein said casing is detachably fastenable to said portable basketball backboard and hoop set.

5. The measuring apparatus of claim 1 wherein said measuring apparatus is further designed and configured to indicated the position of the centerline, center circle and restricting circle of a basketball court.

6. A method for indicating the position of the boundaries and indicia of a basketball court upon a planar surface about the basketball hoop of a portable basketball backboard and hoop set comprising the steps:

(a) providing a generally planar surface and a portable basketball backboard and hoop set having a measuring strip formed thereon and extensible therefrom, said elongate measuring strip having indicia formed thereon for indicating the position of the baseline, freethrow line, and three-point line of a conventional basketball court upon said planar surface relative said portable basketball backboard and hoop set when said hoop of said portable basketball backboard and hoop set is maintained in an elevated configuration;

(b) securely positioning said portable basketball backboard and hoop set with the elongate measuring strip affixed thereto upon said planar surface;

(c) extending said measuring strip about said planar surface and forming markings upon said planar surface corresponding to the baseline, freethrow line, and three-point line of said conventional basketball court as indicated by said indicia formed upon said measuring strip; and (d) withdrawing said measuring strip from said planar surface.

7. The method of claim 6 wherein step (c) further comprises rotating said measuring strip about said planar surface to indicate said three-point line of said basketball court.

8. The method of claim 6 wherein:

(a) step (a) further comprises providing chalk; and (b) wherein in step (c) said markings are formed by ablating said chalk upon said planar surface.

9. The method of claim 6 wherein:

(a) step (a) further comprises providing adhesive tape; and (b) wherein in step (c), said markings are formed by affixing one or more strips of said adhesive tape to said planar surface.

10. The method of claim 6 wherein:

(a) step (a) further comprises providing paint; and (b) wherein in step (c), said markings are formed by applying said paint to said planar surface.

11. The method of claim 6 wherein in step (a), said measuring strip further includes indicia for indicating the position of the sidelines of said basketball court.

12. The method of claim 6 wherein in step (a), said measuring strip further includes indicia for indicating the position of the centerline, center circle, and restricting circle of said basketball court.

* * * * *